US006802758B2

(12) United States Patent
Somers

(10) Patent No.: US 6,802,758 B2
(45) Date of Patent: Oct. 12, 2004

(54) ORBITAL SPINNING DANCING LIGHT TOY WITH CONNECTORS FOR MOUNTING LIGHT EMITTING ELEMENTS

(76) Inventor: Andrew Michael Somers, P.O. Box 1867, Hollywood, CA (US) 90078

( * ) Notice: Subject to any disclaimer, the term of this patent is extended or adjusted under 35 U.S.C. 154(b) by 0 days.

(21) Appl. No.: 10/386,328

(22) Filed: Mar. 11, 2003

(65) Prior Publication Data

US 2003/0176145 A1 Sep. 18, 2003

Related U.S. Application Data

(60) Provisional application No. 60/363,611, filed on Mar. 12, 2002.

(51) Int. Cl.[7] ..... A63H 1/28; A63H 1/06; A63H 5/00; A63H 33/26

(52) U.S. Cl. ..... 446/242; 446/247; 446/397; 446/485

(58) Field of Search ..... 446/247–254, 446/397, 242, 485, 484; 362/295, 231, 276, 802

(56) References Cited

U.S. PATENT DOCUMENTS

| | | | | | |
|---|---|---|---|---|---|
| 3,010,248 | A | * | 11/1961 | Ellman | 446/22 |
| 3,501,860 | A | | 3/1970 | Bandy | |
| 3,721,037 | A | | 3/1973 | Allen | |
| 3,834,069 | A | * | 9/1974 | Brown | 446/250 |
| 3,924,114 | A | * | 12/1975 | Sanchez | 446/242 |
| 3,954,320 | A | | 5/1976 | Hardesty | |
| 4,189,862 | A | | 2/1980 | Lopez | |
| 4,552,542 | A | * | 11/1985 | Reysman | 446/254 |
| 4,990,091 | A | | 2/1991 | Mir-Heidari | |
| 5,803,784 | A | * | 9/1998 | Plow et al. | 446/176 |
| 6,120,342 | A | * | 9/2000 | Chan | 446/254 |
| 6,482,137 | B2 | * | 11/2002 | Walker | 482/110 |
| 6,491,516 | B1 | * | 12/2002 | Tal et al. | 431/253 |
| 2002/0068505 | A1 | | 6/2002 | Williams | |

* cited by examiner

*Primary Examiner*—Jacob K. Ackun
*Assistant Examiner*—Faye Francis

(57) ABSTRACT

A toy with a plurality of lights that a user can suspend from his hands and spin, twirl, whirl, and otherwise manipulate to create amusing patterns of light. The toy consists of a hub (30), power supply (56), a plurality of light emitting elements (72) which are mounted on the hub using connectors (70), and an additional plurality of light emitting elements (92) which are mounted remotely on wires (170) using connectors (90) and attached to the hub (30) using connectors (52, 172) or (162). A tether (40) to suspend the toy from the users hands (48L, 48R), such as string which is passed though holes (42) in the hub (39). The user can then rotate, twist, wind up, spin, swing and otherwise manipulate the toy causing the light emitting elements (72, 92) to move in various circular and random patterns causing amusing displays of light.

30 Claims, 9 Drawing Sheets

ORBITAL SPINNING DANCING LIGHT TOY WITH CONNECTORS FOR MOUNTING LIGHT EMITTING ELEMENTS

CROSS REFERENCE AND RELATED SUBJECT MATTER

This application is a continuation in part of Provisional Patent Application Ser. No. 60/363,611 filed in the United States Patent Office on Mar. 12, 2002 and is entitled to the benefit of said filing date.

BACKGROUND—FIELD OF INVENTION

This invention is related to toys, and specifically to light up toys that spin under user control.

BACKGROUND—DESCRIPTION OF PRIOR ART

Playing with light toys, such as glow sticks and high brightness flashlights can be fun in dark environments, such as dance clubs, camping at night, and at night time parties such as you would have for the Fourth of July. Additional amusement can be had if said light toys are bright and moved rapidly to cause streaks or lines of light to be observed by the viewers.

Some rave dancers and light show performers may on occasion put one or more high intensity mini flashlights or glow sticks on a string and holding them with one hand and whirling them around the hand. The glow sticks or flashlights, by their nature, are not evenly balanced and thus difficult to spin for any duration. Also, the patterns of light that can be made with this method are limited to small two dimensional displays that lack the depth of multiple axis rotating orbits.

The common Yo-Yo toy is sometimes fitted with an internal illuminator such as a small internally mounted light bulb, but the method of spinning a yo-yo does not allow it to be spun axially while suspended with both hands parallel to it's axis because it is suspended by a single string that is tangential to its circumference, as opposed to parallel to it's axis. One result of this is that it is difficult if not impossible to manipulate a yo-yo to provide certain orbiting or spiral light patterns. Further, a yo-yo cannot have external lights mounted on strings or wires at distances away from the yo-yo, as this would interfere with the operation of the yo-yo. As such the yo-yo cannot display multiple axis rotating orbits.

U.S. patent application Ser. No. 2002/0,068,505 A1 By Williams (2002) teaches a spinning light up rattle toy. The head of this toy is supported by a solid shaft extending from one side of the head, and is spun by pulling a string wound about the shaft. Its solid shaft prevents the toy from being suspended from both hands at a distance that would allow the toy to be whirled around in orbital patterns. While this toy is self-illuminating, it requires virtually no skill to operate and as a result has minimal play value.

The prior art also includes various rotating wheels through which a pair of strings extend at spaced points proximate to the axis of the wheel. The strings are twisted typically by a looping motion of the wheel. Thereafter, the axial extremities of the strings extending through the wheel are pulled outwardly away from the wheel causing the wheel to rotate rapidly. Some examples include U.S. Pat. Nos. 4,990,091 (1991), 4,990,091 4,189,862 (1980), 3,721,037 (1973) and 3,501,860 (1970). None of these toys are self-illuminating, and none of these provide for amusement in dark environments as all require external illumination for their particular features to be viewable.

For the process of attaching a light emitting element to the end of a flexible multi conductor cord one could use conventional soldering techniques, but the structural integrity of the cord and its conductors is impaired by stripping and soldering. This is particularly a problem with highly flexible tinsel wire type cords which are easily damaged by the heat of soldering. Further, the soldering techniques required are not well suited to automation or mass production making the time and labor costs prohibitive for the production of a toy.

A related connector for terminating the end of a flexible multi conductor cord is U.S. Pat. No. 3,954,320 Hardesty (1976). This teaches the means to terminate the end of a cord using a connector comprising a dielectric housing with means to anchor to the jacket of the cord and terminals which pierce the insulation of the cord and make contact with the conductors therein. However, this connector does not teach the method for securing a light emitting element to the connector, nor making electrical connection with said light emitting element to the conductors of said cord.

The process of attaching flexible multi conductor cord to a circuit or printed circuit board could be performed using conventional soldering techniques, but as above the structural integrity of the cord and its conductors can be impaired. Using conventional connector systems requires that one connector be joined to the circuit, and its mate joined to the cord, such that the two may be coupled together. But when a non-removable permanent coupling is desired this approach results in unneeded complexity and cost.

For removably connecting a light emitting element with wire leads to a circuit, one could use a conventional female header type connector, where the connector is joined to the circuit, and the light emitting element's wire leads are inserted into the connector's holes making electrical coupling with the connector's internal contacts. While simple, the disadvantage is that if the light emitting element requires a polarity dependant connection, there is no means to ensure that the correct polarity is observed. Using conventional polarity specific connector systems requires that one connector be affixed to the circuit, and its mate affixed to the light emitting element, such that the two may be coupled together observing the correct polarity. The disadvantage with multi piece connector systems is added complexity and cost.

OBJECTS AND ADVANTAGES

Accordingly, several objects and advantages of the present invention are:

To provide an amusing light display device, of which can be controlled and maneuvered by the operator to display many different forms of amusing, pretty light displays, each of which is unique, unexpected, and never exactly duplicable. Accordingly, operating the toy skillfully allows for the display of patterns such as multi axis rotating orbits, complex helixes, spiral flowers, and UFOs.

Another object is to provide the operator a play experience that encourages the development of skill operating the toy, and as such creates significant play value over long periods of time. Accordingly, it takes practice to be able to perform all of the various light displays possible with said toy.

Another object is to allow the colors of the light emitting elements and other aspects of the toy to be easily modified or adjusted so that the operator may customize said toy to his or her desires. Accordingly, the individual light emitting elements may be changed easily, and certain accessories may be added to the toy. Further, the speed or rate of change of strobing, flashing and multi color elements may be adjusted by the operator.

Another object is to provide protection from damage to other objects or individuals while being operated. Accordingly thy toy has a protective resilient covering on the hub and the various light emitting elements. Further the string like support has resilient pads to protect the operators hands and fingers while operating.

Another object is to electrically and mechanically connect a light emitting element to the end of a flexible piece of cord, having two or more flexible conductors, securely such that the connection with said light emitting element and said cord can withstand rapid whirling and twirling, and such that said light emitting element can receive electrical power via said cord.

Another object is to electrically and mechanically connect the end of a flexible piece of cord, having one or more flexible conductors, securely and permanently to an electrical circuit such that the integrity of the flexible conductors is not impaired.

Another object is to provide a connector on a power source to removably connect a light emitting element to the power source maintaining the required polarity without the need for a mating connector on the light emitting element itself.

SUMMARY

The invention, an orbital spinning dancing light toy, has a central hub or flywheel with a plurality of light emitting elements both mounted directly on the hub, and attached via wires away from but connected to the hub. The hub contains a power supply for the light emitting elements, and circuitry for strobing, flashing or blinking some or all of the light emitting elements. The hub is intersected by one or more tethers that are tied to form a loop on either side of the hub. The light emitting elements mounted on the hub are removably mounted into connectors that maintain the correct polarity for the light emitting elements. The light emitting elements connected to but at a distance from the hub are attached to a flexible multi conductor cord by means of a satellite connector that secures the light emitting element securely to the cord while simultaneously making electrical connection between the light emitting element and the cord's associated conductors. These light emitting element cord assemblies are then removably affixed to the hub of the toy using conventional locking connectors, or permanently affixed to the hub using the connector as described in the present invention.

The user controls the device by placing each hand through each tether loop. The user then "winds up" the device by rotating his hands in a circular motion around the axis of the hub. The wind up motion produces an interesting light display in itself. The user can then pull the tethers tight, and the hub and wire connected lights will spin tightly, forming circles of light of various diameter. The user can further manipulate the device by applying different levels of pressure on the tether, and moving his hands in different directions. Further, the user can "dance" with the device and make the various light emitting elements move to music. Appropriate hand motions will cause the device to form many new and unique spiral, bouncing, orbiting, and random displays of light.

DRAWINGS

In the drawings, closely related figures have the same number, but different alphabetic suffixes.

FIG. 1A shows the toy's suspending cord straight, and FIG. 1B shows the cord twisted, as after spinning.

FIGS. 10A thru 10D detail the contact for the preferred embodiment satellite connector.

Figure 11:
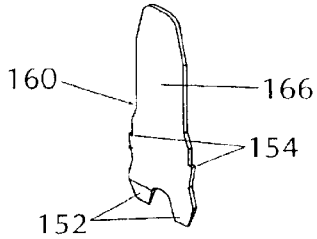

FIG. 11 details the contact for the alternate embodiment of the satellite connector.

Figure 12:
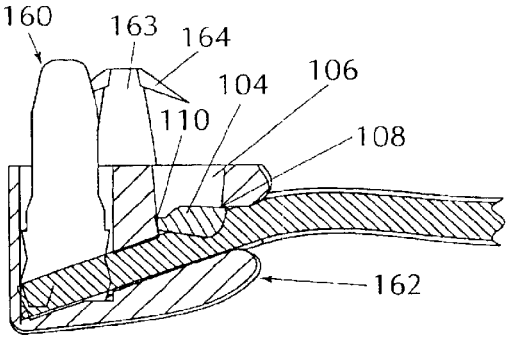
Figure 13A:
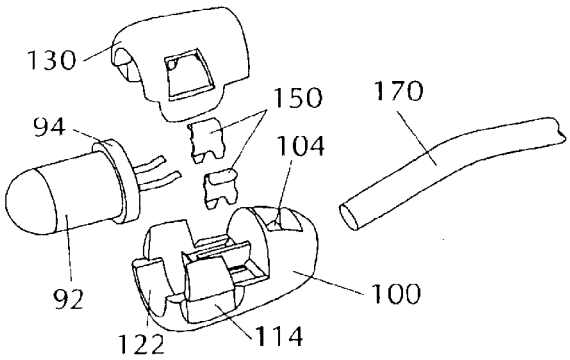
Figure 13B:
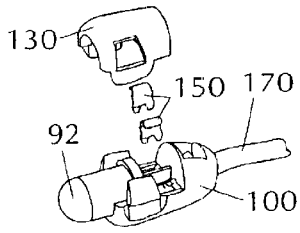
Figure 13C:
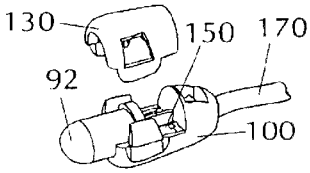
Figure 13D:
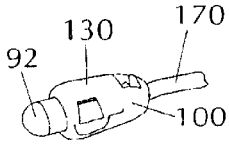

FIG. 12 is a sectional side view for the alternate embodiment of the satellite connector.

FIGS. 13A thru 13D is a set of views detailing the assembly of the satellite connector.

Figure 14A:
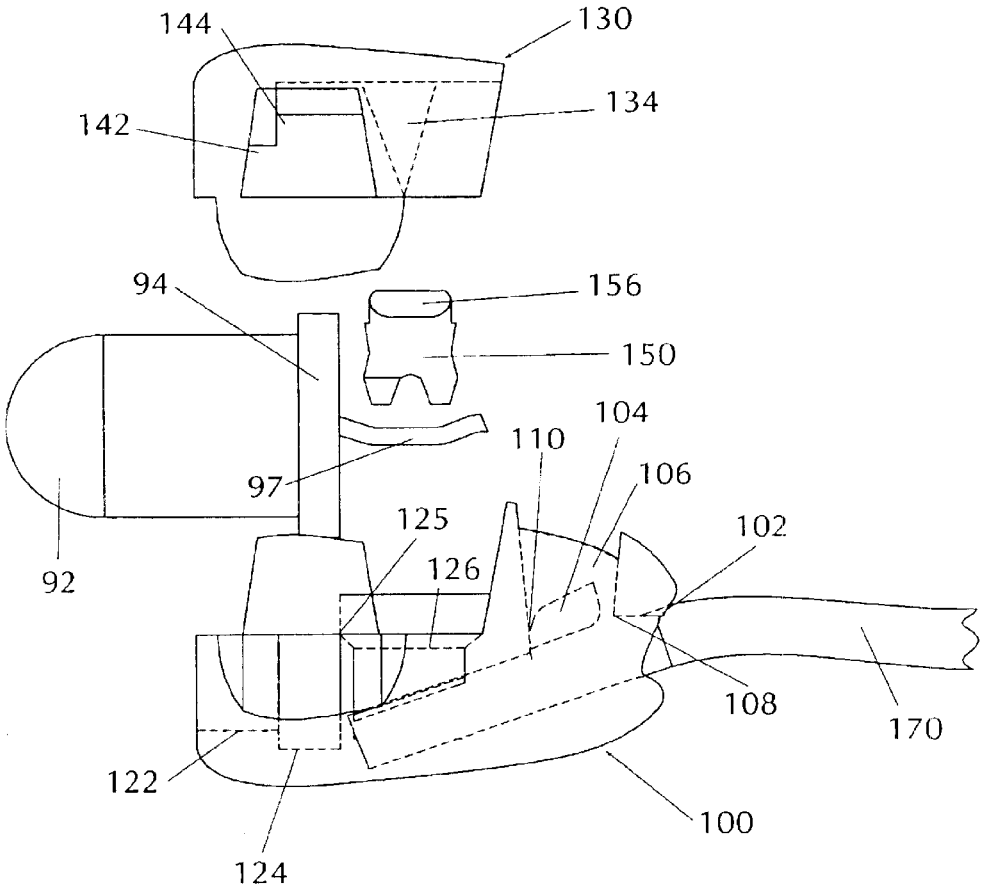
Figure 14B:
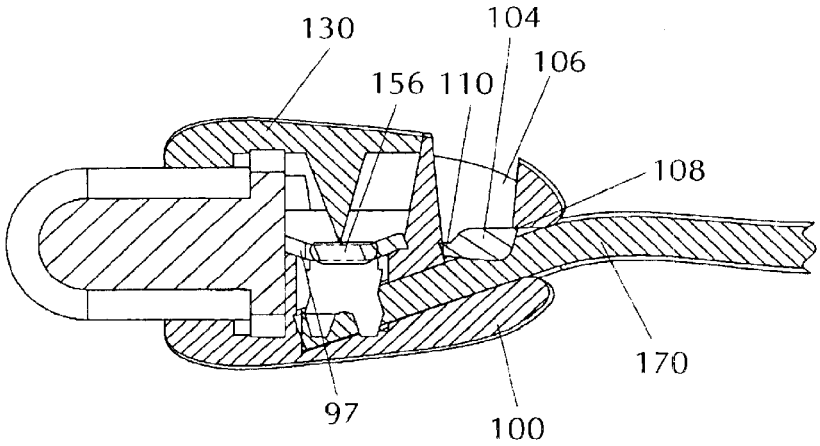
Figure 15:
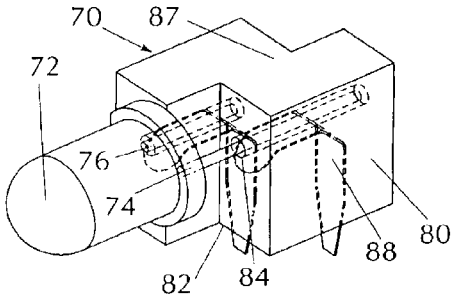

FIGS. 14A and 14B is a sectional side view for the main embodiment of the satellite connector FIG. 15 is an overview of the internal illuminator connector.

Figure 16A:
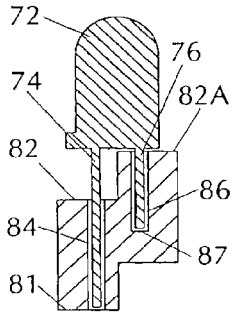
Figure 16B:
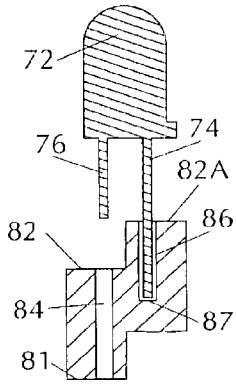
Figure 17A:
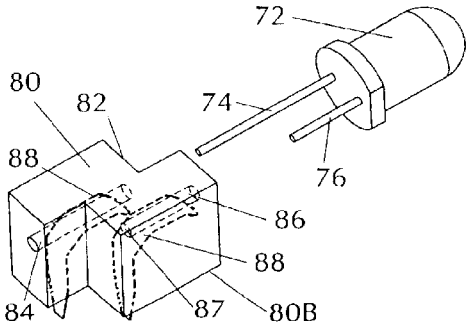
Figure 17B:
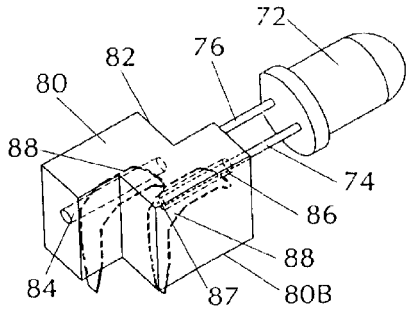
Figure 18:
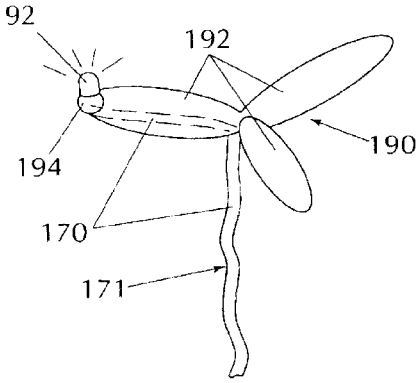

FIGS. 16A and 16B are top sectional views of the internal illuminator connector FIGS. 17A and 17B are side perspective views of the internal illuminator connector FIG. 18 is an overview of the illuminator wobbler assembly.

Figure 19:
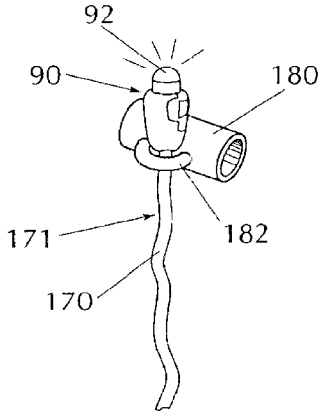

FIG. 19 is an overview of the noise maker assembly.

Figure 20:
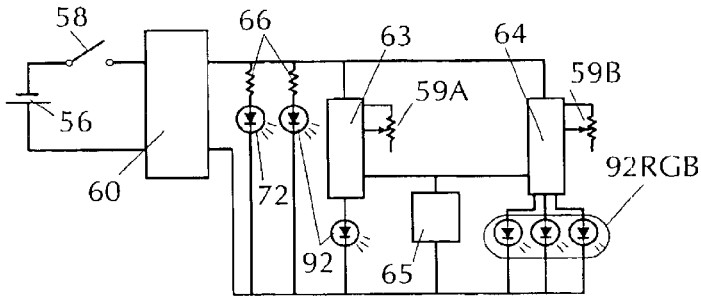

FIG. 20 is a simplified electronic schematic for the preferred embodiment of the hub.

Figure 21:
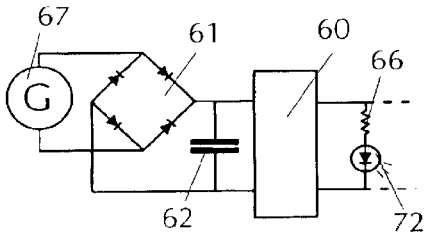

FIG. 21 is a simplified electronic schematic for the second embodiment of the hub.

Figure 22:
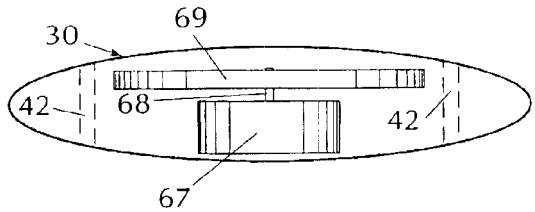

FIG. 22 is a simplified cross section of the second embodiment of the hub.

Figure 23A:
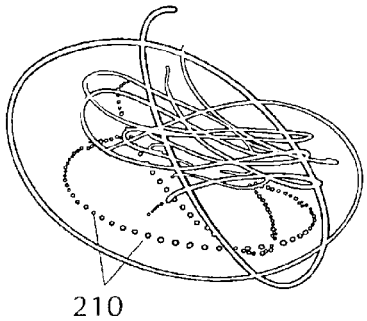
Figure 23B:
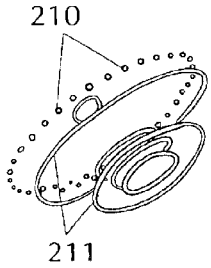
Figure 23C:
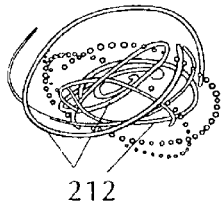

FIGS. 23A–23C are line tracings from photographs that show example displays presented by the invention.

REFERENCE NUMERALS USED IN FIGURES

30 Body or hub assembly
30A Circumference of said hub
31 Rotational axis of hub
32 Upper half of body or hub
32A—First side of said hub
34 Lower half of body or hub
34A—Second side of said hub
35 Battery opening
36 Battery cover
37 Holes for fasteners
38 Fasteners
39 Resilient covering

40 Tether such as String, twine, or cord
40A Tether such as String, twine, or cord twisted or wound up
41 Tether loop
42 Hole for Tether
43 Knot or stop on Tether
44 Resilient handle
45 Hole in resilient handle for Tether
46L, 46R—Operators hands
47 Hole for locking satellite connector jack
48 Clip
50 Electronics assembly
51 Circuit board
52 Locking satellite connector jack
54 Power storage cell contact
56 Power storage cell
58 Switch
59A, 59B—Operator adjustment control
60 Voltage regulator/booster assembly
61 Voltage rectifier
62 Electrical storage means
63 Strobe circuit
64 Color cycle circuit
65 Spin and motion rate sensor
66 Current limiting resistor
67 Generator
68 Generator shaft
69 Flywheel
70 Internal light emitting element connector
72 Internal light emitting element
74 Internal light emitting element long lead
76 Internal light emitting element short lead
80 Internal light emitting element connector body
80B Internal light emitting element connector body bottom
81 Internal light emitting element connector body back face
82 Internal light emitting element connector step
82 Internal light emitting element connector face forward of step
84 Internal light emitting element connector long hole
86 Internal light emitting element connector short hole
87 Internal light emitting element connector lead insertion stop
88 Internal light emitting element connector electrical terminal
90 Satellite light emitting element connector
92 Satellite light emitting element
92RGB—Multi-color light emitting element
94 Satellite light emitting element flange
96 Satellite light emitting element leads
97 Satellite light emitting element leads distorted under tension
99 Resilient covering
100 Satellite light emitting element connector body—lower
102 Aperture for wire
104 Latch
106 Latch opening
108 Latch catch
110 Latch hinge
114 Indentation under tinecatch
116 Tine
118 Tine catch
120 Insulating divider
122 Light emitting element body recess
124 Light emitting element flange recess
125 Ridge under Satellite light emitting element lead
126 Terminal seat
128 Terminal hole
130 Lees connector body—upper
132 Hood
134 Wedge
136 Opening for accepting lower body tine
138 Lip that snaps over tine catch
142 Light emitting element body recess
144 Light emitting element flange recess
150 Terminal
152 Tangs
154 Barbs
156 Folded over tab
158 Indentations in tab
160 Long neck terminal
162 Satellite permanent attachment connector
163 Connector stubs
164 Barbs
166 Long neck
170 Flexible multi conductor satellite line cord
171 Satellite light emitting element cord assembly with locking connector
172 Locking connector
173 Satellite light emitting element cord assembly for permanent attachment
180 Whistle
182 Whistle clip
190 Wobbler
192 Wobbler eccentric elements
194 Wobbler illuminator holder
200 Operator circular hand motion
201 Operator outward hand motion
202 Operator opposite direction hand motion
210 Light display of dots
211 Light display of concentric circles
212 Light display of multi axis orbits

DETAILED DESCRIPTION

Figure 1A:
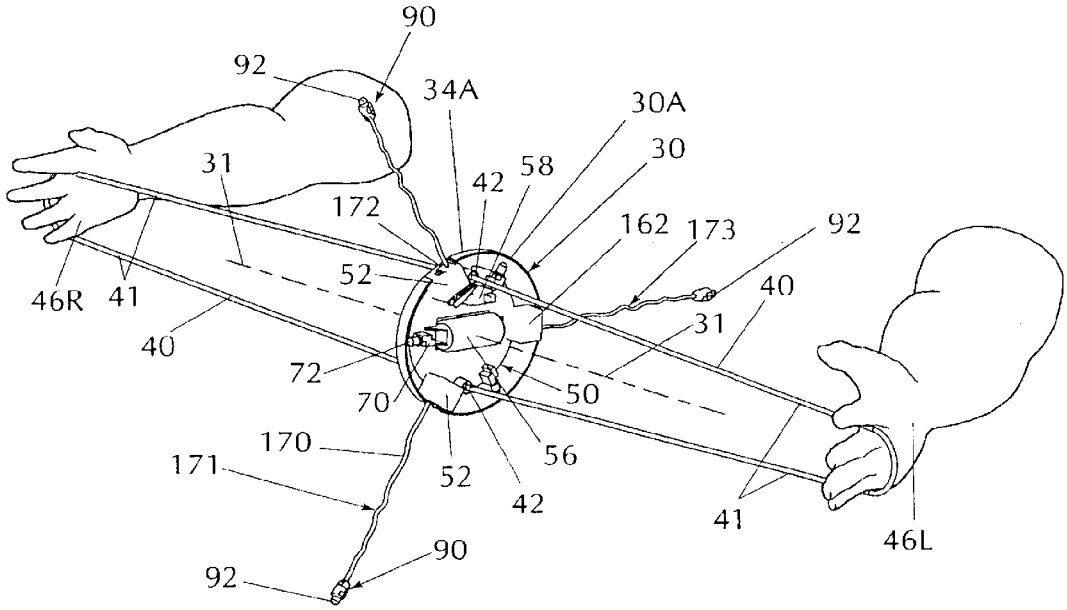
FIGS. 1A and 1B show an overview of the toy suspended from the operator's hands.

FIG. 1A illustrates a circular or cylindrical hub 30 in the shape of a disk having a first side 32A, a second side 34A, a circumference 30A, and a rotational axis 31. The hub has holes 42 extending between the first and second sides through which a tether 40, namely a string, twine, or cord is passed to form loops 41 on each of the first and second sides of the hub 30 through which the operator can place his/her hands 46L,46R to support and spin the hub 30 in a manner which will be described herein below. Mounted in or on the hub 30 is electrical assembly 50 which includes an electrical circuit, or printed circuit board 51. A power storage cell such as a battery 56 is connected to the electrical assembly 50 by battery contacts 54 which are affixed to the circuit board 51. A power control device such as a switch 58 is affixed to circuit board 51. A plurality of light emitting elements 72 are mounted in the hub 30 or on the circuit board 51 so that they are visible from outside the hub. In this regard the hub is generally at least partially made of a translucent or transparent material. Satellite light emitting element cord assemblies 171 are provided each having an additional light emitting element 92 attached at the end of a flexible multi conductor satellite line cord 170 by means of a light emitting satellite connector assembly 90. The opposite end of the satellite line cord 170 is then terminated into a locking plug connector 172. The satellite light emitting element cord assembly 171 with locking connector 172, is removably attached to the hub 30 by inserting the plug connector 172 into receiving jack 52 which is affixed to circuit board 51. Permanently attached to the hub wherein there are additional light emitting elements 92 are attached at the ends of other satellite line cord 170 by means of a light emitting satellite connector assembly 90, but The opposite end of the satellite line cord 170 is then terminated into satellite permanent attachment connector 162 forming Satellite light emitting element cord assembly for permanent attachment 173, wherein connector 162 is affixed to circuit board 51.

Figure 2:
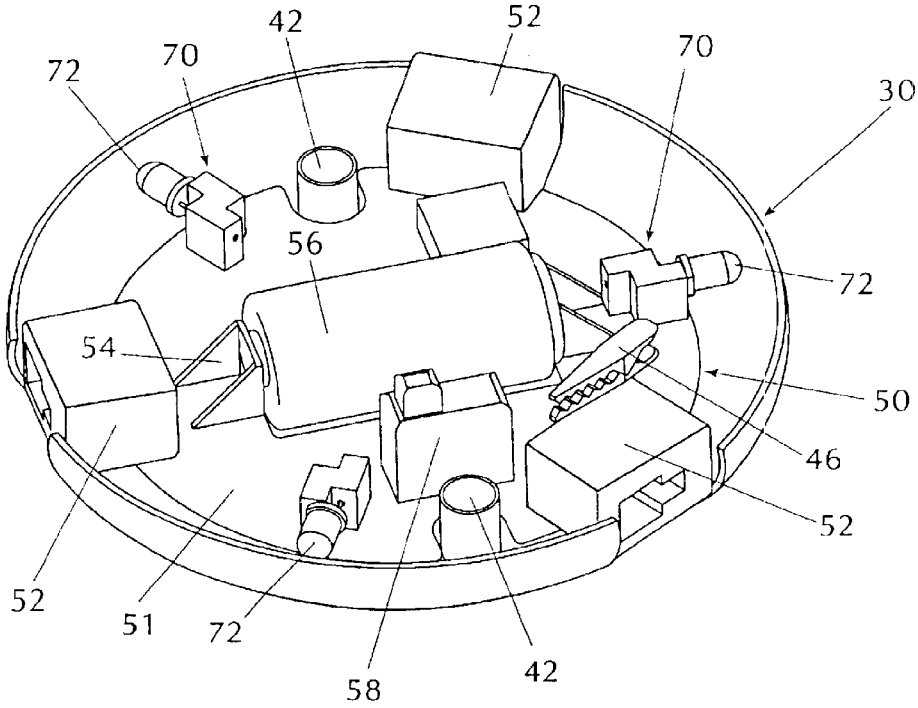
FIG. 2 shows an overview of the main components of the preferred embodiment of the hub, where means to power is a storage cell such as a battery
Figure 6:
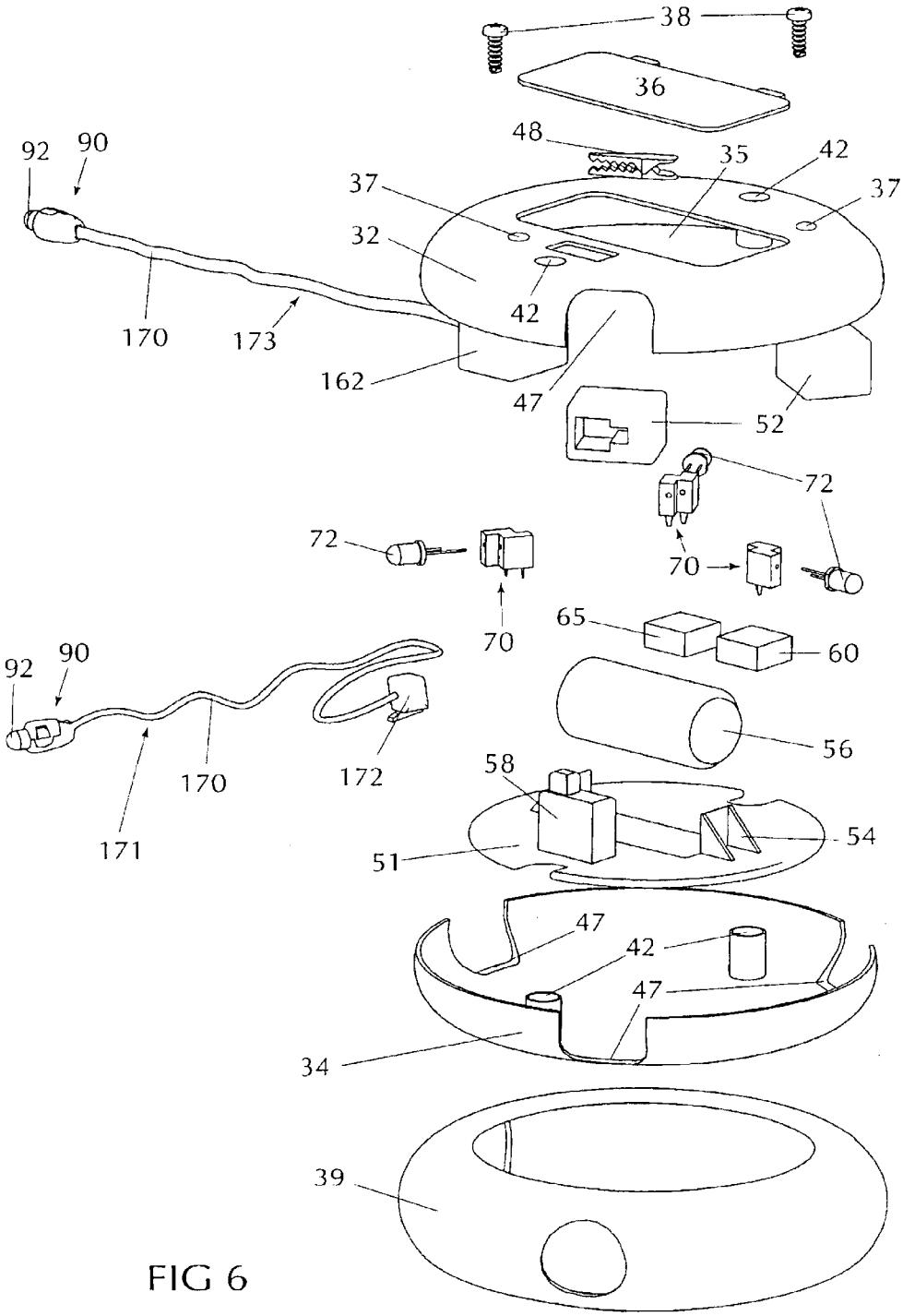
FIG. 6 is and exploded view of the hub.

FIG. 2 and FIG. 6 illustrates in more detail the components mounted in or on the hub 30. The electrical assembly 50 which includes circuit board 51 which provides electrical connection between the components (see FIG. 20). The battery 56 is connected to the electrical assembly 50 by battery contacts 54 and 54 which are affixed to the circuit board 51. The switch 58 is affixed to circuit board 51. The plurality of light emitting elements 72 is mounted in or on the circuit board 51 by means of a plurality of internal light emitting element connectors 70. Jack 52 is affixed to circuit board 51 with it's aperture facing outward from the center of the hub 30 to permit removable locking connection with external accessories such as satellite light emitting element cord assembly with locking connector 171. Light emitting element 92 is attached at the end of satellite line cord 170 by means of connector assembly 90. The opposite end of the satellite line cord 170 is then terminated into satellite permanent attachment connector 162 which is affixed to circuit board 51.

Figure 4:
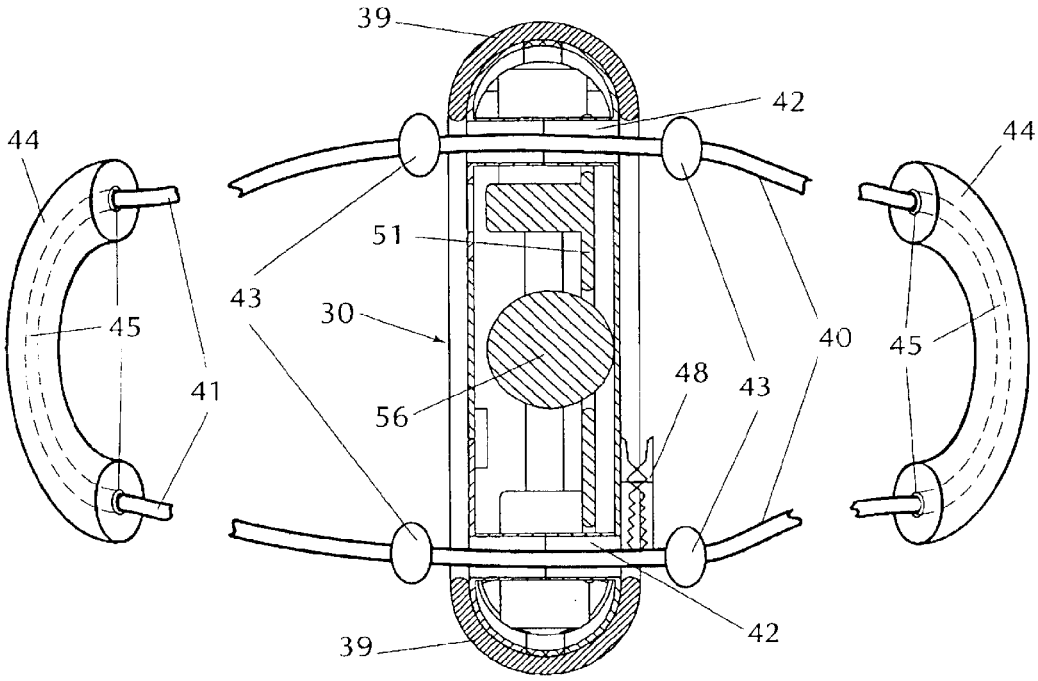
FIG. 4 shows a side view of the hub, and details the arrangement of the cord-like means to suspend and related components.

FIG. 4 illustrates a side cross sectional view of the toy. The outer perimeter of the hub 30 is covered by a transparent or translucent resilient sheathing such as urethane 39. The Tether 40 passes through the hub 30 via holes 42 and a movement restrictor namely a stop, knot, or knob 43—43 are affixed to the Tether 40 proximate to the hub 30 to prevent excess sliding through the hub holes 42. The outer ends of the Tether loops 41 and 41 are covered with a resilient material to form handles 44 by threading the tether 40 through holes 45 in the handles.

Figure 5:
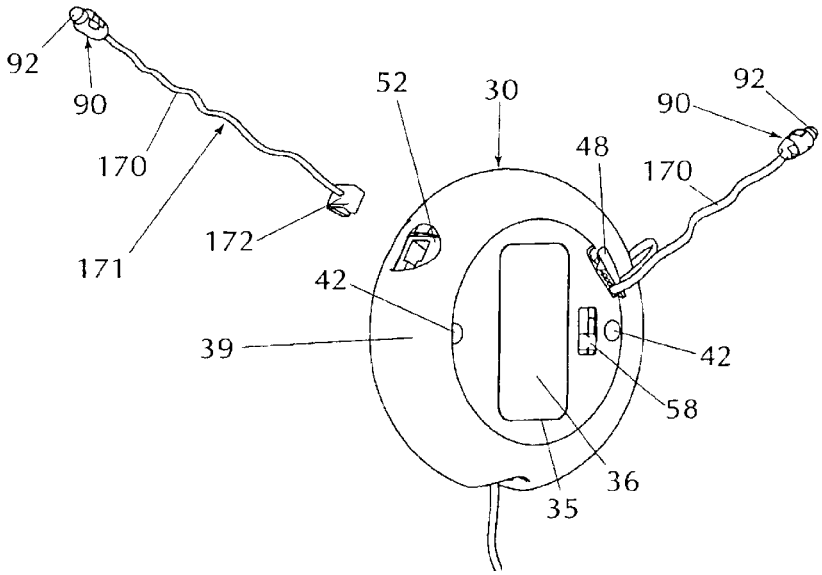
FIG. 5 is an overview of the relationship between the hub and satellites.

FIG. 5 illustrates a view showing satellite light emitting element cord assembly with locking connector 171 detached from the hub 30 showing orientation of locking plug 172 to accepting jack 52. Also illustrated are clips 48 and 48 which are used to hold and adjust the useable length of the satellite cord assemblies 171 and 173. Removable battery cover 36, which covers battery access hole 35 to facilitate replacement of the battery is provided.

FIG. 18 illustrates how a light emitting element 92 is attached to a wobbler assembly 190 by wobbler light element holder 194 which accepts satellite line cord 170. Wind vanes 192 are attached to holder 194. When the wobbler assembly is caused to pass through the air, the wind vanes cause the wobbler to fluctuate in an eccentric manner, causing the light emitting element to display wobbly lines of light.

FIG. 19 illustrates a wind operated sound making device 180 clipped onto satellite line cord assembly 171 by means of clip 182. When the wind operated sound making device 180 is passed through the air by spinning the toy, sound is produced.

FIG. 20 illustrates a simplified schematic of the electrical connections of electrical assembly 50. Battery 56 is connected to switch 58 and then to voltage booster means 60 which is then connected to light emitting elements 72, 92. Conventional stobe means 63 is connected to light emitting element 92. Operator strobe control 59A is connected to stobe means 63. Conventional color cycling means 64 is connected to light emitting element 92RGB. Operator color cycling control 59B is connected to color cycling means 64. Motion sensor 65 is connected to control inputs of the stobe means 63 and color cycling means 64.

To facilitate interconnectivity of various elements of the invention, several connectors and connector assemblies are employed and discussed herein below.

Figure 7:
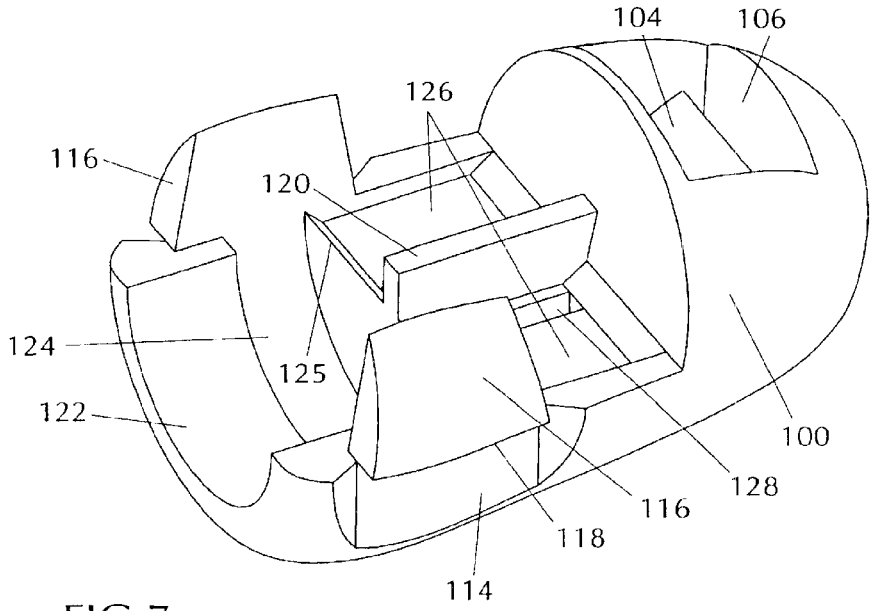
FIG. 7 is a front overview of the lower body of the satellite connector.
Figure 8:
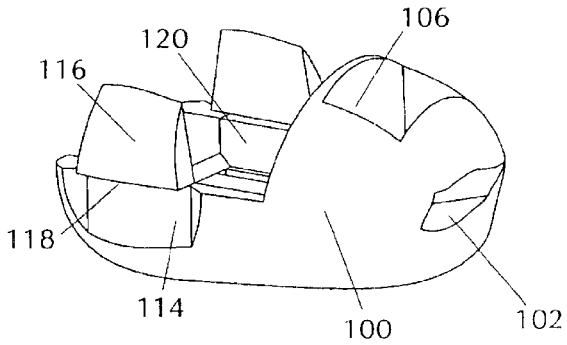
FIG. 8 is a rear overview of the lower body of the satellite connector.

In particular, FIGS. 7 and 8 illustrate the lower body 100 of the light emitting satellite connector assembly 90. The body 100 is composed of a dielectric material and has an aperture 102 suitable for accepting satellite line cord 170 (not shown here), above which is latch 104 in latch access opening 106. Recess 122 to accept light emitting element 92 (see FIG. 14A) and larger recess 124 to accept the flange of light emitting element 94 (see FIG. 14A). The sides of the body have vertical tabs or tines 116 with a lower lip or tine catch 118 which juts out from the body over indentation 114. Insulating divider 120 sits between instantiations of contact holes 128 which are surrounded by an area 126 lower in the body than ridge 125.

Figure 9:
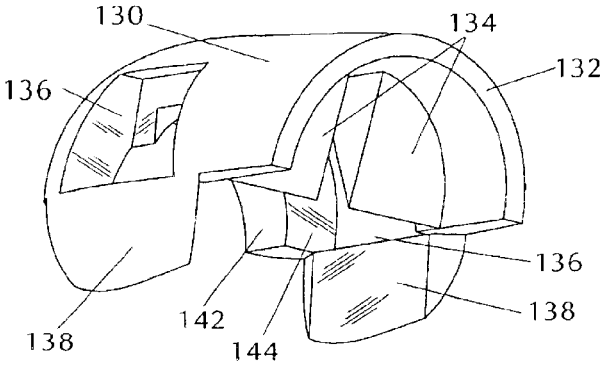
FIG. 9 is a rear overview of the upper body of the satellite connector.
Figure 10A:
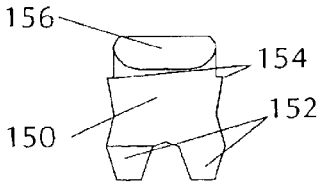
Figure 10B:
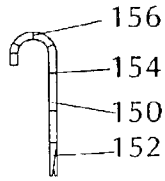
Figure 10C:
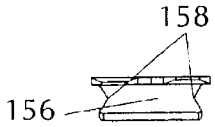
Figure 10D:
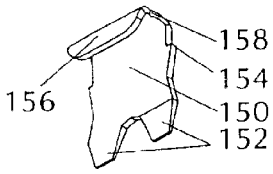

FIG. 9 illustrates the upper body cap 130 of light emitting satellite connector assembly 90. It is made from a dielectric material and comprises a covering hood 132, terminal pressure wedges 134, openings 136 and 136 for accept the tine 116 of the upper body, lip 138 to snap over tine catch 118. Recess 142 to accept light emitting element 92 (see FIG. 14A) and larger recess 144 to accept the flange of light emitting element 94 (see FIG. 14A).

With reference to FIGS. 10A thru 10D and FIG. 14A illustrate the terminal 150 used in connector assembly 90. The terminal is made from electrically conducting material that is not prone to significant corrosion. Spikes 152 are suitable for piercing insulation of the satellite line cord 170 and making electrical connection with the satellite line cord's associated conductors. Barbs 154 lock the terminal in place when it is inserted into the connector's lower body 100. And the top of the terminal is folded over tab 156 with the folded tab having indentations 158 to allow for the light emitting element's leads 96 to be distorted 97 into the terminal's folded over tab 156.

FIGS. 11 and 12 illustrates the terminal 160 used in connector 162. The terminal is made from electrically conducting material that is not prone to significant corrosion. Spikes 152 are suitable for piercing insulation of the satellite line cord 170 and making electrical connection with the satellite line cord's associated conductors. Barbs 154 lock the terminal in place when it is inserted into the connector's body 162. The terminal has a long neck 166 which protrudes beyond the body of connector 162. The body 162 is composed of a dielectric material and has an aperture 102 suitable for accepts satellite line cord 170 and latch 104 is bent at latch hinge 110 to snap against latch catch 108 and press against cord 170 locking cord 170 into place and preventing external forces common to the normal use of the toy from affecting the integrity of the electrical connection to the cord 170. The connector body 162 has protuberances, tabs or studs 163 with barbs 164 suitable for securing the connector 162 to another object such as circuit board 51.

FIGS. 14A and 14B illustrate a cross sectional view of connector 90. Light element 92 sits in lower body recess 122 and upper body recess 142. The Light element flange 94 is accepted by lower body recess 124 and upper body recess 144. Terminal 150 is pressed through terminal opening 128 and into the associated conductors of cord 170. The terminal's fold over tab 156 is pressed over light emitting element leads 96 pulling the leads down to the terminal seat 126 this distorts the leads 97 into the terminals tab indentations 158 against connector ridge 125. Satellite line cord 170 enters aperture 102 and latch 104 is bent at latch hinge 110 to snap against latch catch 108 and press against cord 170 locking cord into place and preventing external forces common to the normal use of the toy from affecting the integrity of the electrical connection to the cord 170. Connector upper body 130 is pressed over the lower body such that the lower body tines 116 and 116 engage the upper body tine receiving lips 138 and 138 securing the upper body in place. The wedges 134 provide positive pressure against terminal 150 to ensure that electrical contact is maintained. After assembly, the connector 90 is sheathed in a transparent or translucent resilient covering such as urethane 99.

FIGS. 13A–D illustrates the steps in assembling connector 90. First, satellite line cord 170 in inserted into aperture 102 then latch 104 is pressed into place. Light Emitting Element 92 is set into receiving recess 122, and the flange of light emitting element 94 is accepted by recess 124. Terminals 150 and 150 are pressed through terminal openings 128 and 128 and into the associated conductors of cord 170. The terminal's fold over tab 156 is pressed over light emitting element leads 96 and 96. The upper body cap 130 is then snapped into place over the lower body 100.

FIGS. 15, 16A, 16B, 17A and 17B illustrate the internal light emitting element connector 70 comprising a dielectric body 80 having an offset step 82 on its front surface. The offset step 82 possessing an aperture 84 that extends through the back surface 81 of the connector body 80. The surface forward of the offset 82A has an aperture 86 of predetermined length that ends with a stop 87. The body 80 contains electrical contacts 88 and 88. Each contact 88 extends below the bottom 80B of connector body 80 to facilitate connection with an external electrical circuit. The contacts 88 and 88 extend into the body and into each aperture 84,86 to provide for electrical contact with leads inserted into the apertures. The connector provides a removable electrical coupling directly to the leads of a light emitting element 72 element having a pair of parallel leads where one of the leads is a long lead 74 which is a predetermined length longer than the other short lead 76. The shorter aperture 86 being intended for receiving only the short lead 76, the other aperture 84 intended for receiving only the long lead 74. The step 82 offsets the front surface 82A by a predetermined amount such that if the long lead 74 is inserted into the aperture 86, the short lead 76 cannot reach and there for cannot enter the aperture 84 and thus cannot electrically couple with said electrical circuit.

Figure 3:
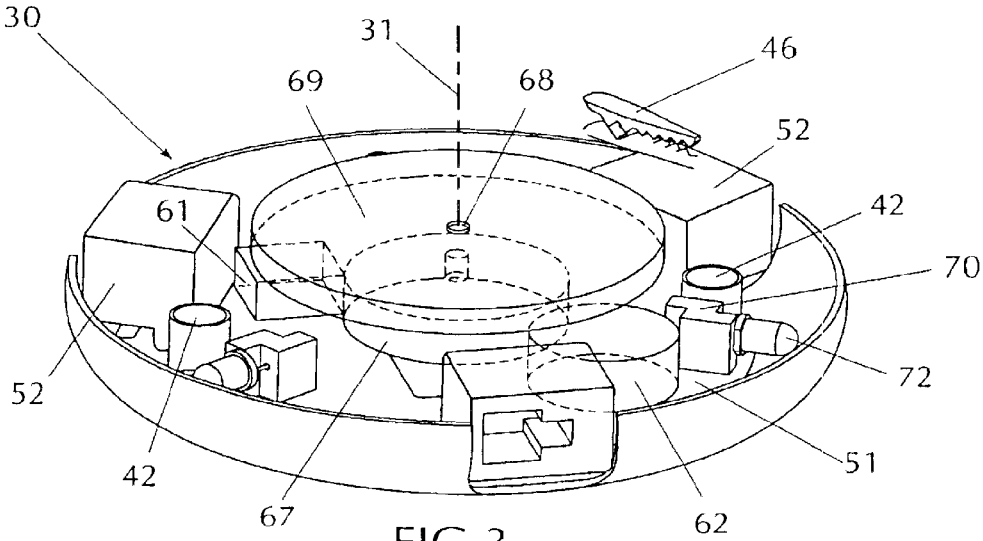
FIG. 3 shows an overview of the main components of a second embodiment of the hub, where means to power is a flywheel driven generator.

With reference to FIGS. 3, 21 and 22 we illustrate an alternate embodiment where the means to power is an electrical generator 67 mounted in or on the hub 30 such that the rotational axis of the input shaft 68 of the generator 67 shares a rotational axis of the hub 31. An inertial mass such as a flywheel 69 is affixed to the shaft 68 and the flywheel can rotate independently and freely from the hub 30. The electrical output of the generator 67 is connected to a rectifier 61 such that direct current is provided of a specific polarity regardless of the rotational direction of the generator's input shaft 68. The output of the rectifier is connected to a current storage device such as a capacitor 62, which is then connected to voltage regulation means 60, the remainder of the circuit being like that of the preferred embodiment.

Operation

Typically, the invention is used in an environment with reduced ambient light conditions, where the lower the ambient light, the more pronounced the effect of the light displays present by the invention.

Figure 1B:
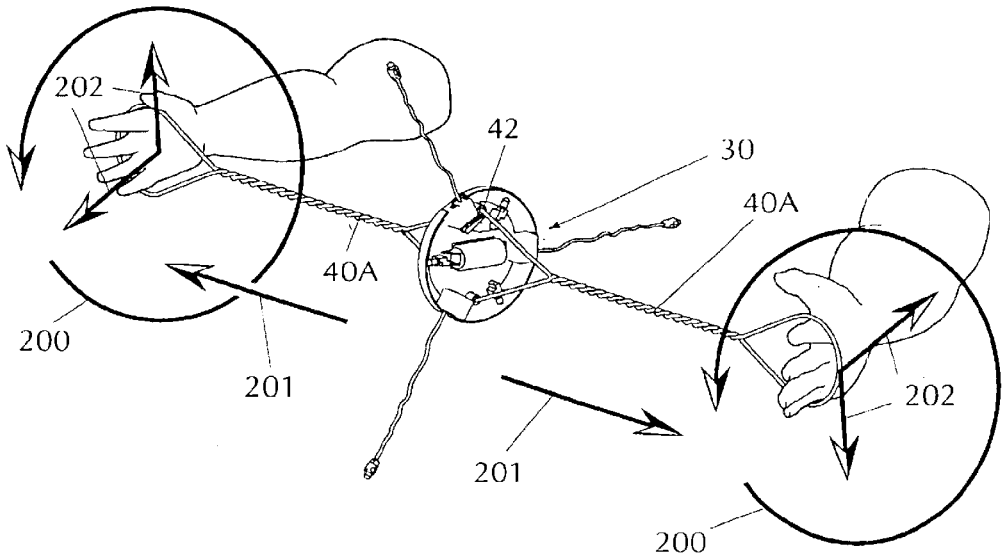

FIGS. 1A and 1B show how an operator might hold and use the preferred embodiment of the toy. Typically, the operator will place each hand through one of the loops 41, formed by the tether 40 on either side of the hub 30, and energize the power for the toy 58. Then the operator will suspend the hub horizontally between the hands and wind the toy up by rotating his hands in circles parallel 200 to the hub 30 and each other to twist the tether 40A. Once the tether 40 is tightly wound 40A (twisted) as shown in FIG. 1B, the operator can exert slight outward pressure 201 away from the hub 30, allowing the hub to begin spinning substantially axially. Over-winding 200 the tether 40A causes slight eccentric motion and the formation of a spiral flower during rotation. Additionally referencing FIGS. 23A–23C illustrates stronger outward pressure 201 without over winding can cause a tighter spinning pattern of concentric circles 211. Outward pressure 201 coupled with rapid hand movements 202 in opposite directions can cause the display of multi axis orbital patterns 212.

The hub 30 operates much like a flywheel or gyroscope in its action. The light emitting elements on flexible multi conductor cord 171, 173 are pulled along with the hub's 30 rotation and will tend to appear to orbit the hub 30. The lights on cords 171, 173 also tend to tangle with the tether 40,40A, which causes the lights on cords 171, 173 to spin off axis of the hub 30, creating a display of circles encircling separate axis.

The cord 170 is of a much lower mass than the light emitting element 92 and connector assembly 90, so that the inertia of the light emitting element assembly 90, 92 allows them to continue on their own orbital path with little effect from the connecting cord 170 (other than preventing the lights from flying away).

Internal light emitting element connector 70, and satellite light emitting element assembly locking connectors 52, 172 allow the user to remove and replace the various light emitting elements 72, 92 such that different colors of light emitting elements can be chosen. Accordingly, the user can determine what collection of colors he or she wishes to display.

Referencing FIGS. 20, 23A, and 23B, By strobing 63 one or more light emitting elements 72, 92, at an appropriate rate while spinning the hub, the light emitting elements can display a series of dots or dashes in the air 210, as opposed to continuous circles 211. The operator can have control over the rate of strobe for both on and off cycles 59A, 59B.

The strobing circuit 63 can be further controlled by using motion sensors 65. These sensors detect the mode of spin and alter the rate or enable/disable the strobe circuit 63.

Individual light emitting elements 72, 92 can be of the multi color type 92RGB, and possess means to change their color 64 at various rates of change according to settings made by the operator 59A, 59B. Further, motion sensor 65 can alter the rate of color change based on the spin rate.

Conclusion, Ramifications, and Scope

Accordingly, the reader will see that the present invention presents a toy with a new play experience that is capable of displaying unique and amusing light figures.

The present invention recites novel connector systems to simplify the assembly of and thus reduce the cost of manufacturing they toy. The satellite connector system in particular provides a robust method of attaching light emitting elements such that satellite elements resist the forces that could damage them during play.

In furtherance of the goals of the invention, said invention has been illustrated by example in the accompanying drawing figures and throughout the written description. It should be appreciated though that numerous variations are possible while adhering to the inventive concept. For example, it should be clear to someone familiar with the art that the hub could be formed in many shapes, and is not limited to a disk shape to function. Such variations are contemplated as being part of the present invention.

What is claimed is:

1. A toy, for use by a user having a pair of hands, for creating displays of light, comprising:

A) a hub, in a shape of a disk, having a first side and a second side, a circumference, and an axis centrally located within the circumference and extending perpendicularly between the first and second sides;

B) a tether extending laterally from the first and second sides substantially parallel to the axis for allowing a user to support the hub while allowing the hub to spin substantially about the axis; and C) at least one light emitting element within the hub, visible from outside the hub, for providing a visual display when the hub is spun; and D) at least one satellite assembly comprising a cord connected to the hub on one end, and having a free end opposite therefrom, the satellite assembly further comprising a satellite light emitting element at said free end so that when the hub is spun the cord will extend radially from the hub and the satellite light emitting element will orbit substantially around the axis.

2. The toy as recited in claim 1, wherein the tether includes a pair of loops, one loop extending laterally from the first side and the other loop extending laterally from the second side, for allowing the user to suspend the hub between the hands of the user by inserting the hands within the loops.

3. The toy as recited in claim 2, wherein resilient material is provided on the loops to protect said user's hands from chafing, bruising, or abrasions.

4. The toy as recited in claim 1, wherein the satellite assembly further comprises a wobbler assembly adjacent to the satellite light emitting element therein to cause said satellite light emitting element to fluctuate in its orbit.

5. The toy as recited in claim 1, further comprising a wind operated noise maker attached to satellite assembly to create sound when said toy is spun.

6. The toy as recited in claim 1, wherein means are provided to allow said user to add and remove light emitting element and the satellite light emitting element.

7. The toy as recited in claim 6, where said the means to add and remove the light emitting elements enforces consistent polarity upon removal and reconnection.

8. The toy as recited in claim 1, further comprising:

A) an electric generator, having an input shaft and output terminals, the generator mounted to the hub such that said input shaft is coaxial with said hub;

B) an inertial mass affixed to the input shaft such that said inertial mass is able to rotate independently with respect to said hub whereby spinning said toy about said axis causes said generator to rotate, and said inertial mass resists such rotation causing said input shaft to resist such rotation such that said generator shall rotate relative to said shaft, causing said generator to provide electrical current.

9. The toy as recited in claim 8, where means are provided to rectify said electrical current from said generator such that direct current with voltage of a consistent polarity is provided to the light emitting element and the satellite light emitting element regardless of the direction of rotation of said generator's input shaft.

10. The toy as recited in claim 9, where means are provided to store excess electrical current and subsequently supply said current to the light emitting element and the satellite light emitting element while said generator is not providing adequate current to illuminate the same.

11. The toy as recited in claim 1, wherein means are provided to cause the light emitting elements to perform one of strobing, blinking, or flashing at a predetermined rate.

12. The toy as recited in claim 11, where the rate of said strobing or flashing shall be fast enough such that moving the light emitting element shall create the appearance of a pattern of dots of light.

13. The toy as recited in claim 11, wherein means are provided to detect a mode of spin of said toy and alter the strobing, blinking, or flashing rate accordingly.

14. The toy as recited in claim 11, wherein said user has means to control the rate of said strobing, blinking or flashing.

15. The toy as recited in claim 1, wherein means are provided to cause the light emitting element and the satellite light emitting element to change color.

16. The toy as recited in claim 15, further comprising a user control which allows the user to set a rate of color change for the light emitting element.

17. The toy as recited in claim 1, wherein means are provided to allow said user to add and remove the satellite assembly to and from the hub.

18. The toy as recited in claim 1, wherein the circumference of said hub has a resilient material means that will prevent damage or injury if said hub is caused to impact another object, surface, or individual.

19. The toy as recited in claim 1 wherein the satellite light emitting element has a resilient material means that will prevent damage or injury if said light emitting element is caused to impact another object, surface, or individual.

20. The toy as recited in claim 1, wherein means to connect the satellite light emitting element at various distances from said hub uses a flexible insulated multi conductor wire cord.

21. The toy as recited in claim 20, wherein means to connect said satellite light emitting element to the flexible insulated multi conductor wire cord uses a connector comprising:

A) a dielectric body having an aperture that substantially encloses an end of said cord B) means to latch said cord securely into said aperture C) a plurality of electrically conductive terminals positioned within said dielectric body and able to be pressed into said aperture for the purpose of piercing the insulation of the cord and making electrical engagement with associated conductors of the cord, said electrically conductive terminals extending a predetermined distance outside of the body D) a recess in the body for selectively holding a light emitting element securely therein E) said electrically conductive terminals being pressable onto associated leads of said satellite light emitting element to make an electrical connection with the leads and the associated conductors of the cord; and whereby said connector provides mechanical and electrical connection between the cord and the light emitting element.

22. The toy as recited in claim 1, wherein there is a plurality of light emitting elements in the hub.

23. The toy, as recited in claim 1, wherein there is a plurality of satellite assemblies.

24. A toy, for use by a user having a pair of hands, for creating displays of light, comprising:

A) a hub, in the shape of a disk, having a first side and a second side, a circumference, and an axis centrally located within the circumference and extending perpendicularly between the first and second sides;

B) a tether extending laterally from the first and second sides substantially parallel to the axis for allowing a user to support the hub while allowing the hub to spin substantially about the axis; and C) at least one satellite assembly comprising a cord connected to the hub on one end, and having a free end opposite therefrom, the satellite assembly further comprising a satellite light emitting element at said free end so that when the hub is spun the cord will extend radially from the hub and the satellite light emitting element will orbit substantially around the axis.

25. The toy, as recited in claim 24, wherein there is a plurality of satellite assemblies.

26. The toy as recited in claim 25, wherein means are provided to cause the satellite light emitting elements to perform one of strobing, blinking, or flashing.

27. The toy as recited in claim 25, wherein means are provided to cause the satellite light emitting elements to change color.

28. The toy as recited in claim 25, wherein means are provided to allow said user to add and remove individual satellite assemblies to and from the hub.

29. The toy as recited in claim 24, wherein the tether includes a pair of loops, one loop extending laterally from the first side and the other loop extending laterally from the second side, of sufficient size to allow the user to suspend the hub between the hands of the user.

30. The toy as recited in claim 24, wherein the circumference of said hub has a resilient material means that will prevent damage or injury if said hub is caused to impact another object, surface, or individual.

* * * * *